US009915028B1

(12) United States Patent
Daugherty

(10) Patent No.: US 9,915,028 B1
(45) Date of Patent: Mar. 13, 2018

(54) DYE ADDITIVE AND PROCESS FOR DYEING ARAMID FIBERS

(71) Applicant: Ronald Tyler Daugherty, Sarasota, FL (US)

(72) Inventor: Ronald Tyler Daugherty, Sarasota, FL (US)

( * ) Notice: Subject to any disclaimer, the term of this patent is extended or adjusted under 35 U.S.C. 154(b) by 0 days.

(21) Appl. No.: 15/266,761

(22) Filed: Sep. 15, 2016

(51) Int. Cl.
*D06P 7/00* (2006.01)
*D06P 3/24* (2006.01)

(52) U.S. Cl.
CPC ..... *D06P 3/24* (2013.01)

(58) Field of Classification Search
CPC .... D06P 1/62; D06P 1/625; D06P 1/64; D06P 1/645; D06P 1/66; D06P 1/67316; D06P 1/922; D06P 1/94; D06P 3/82; D06P 5/00; D06P 5/003; D06P 3/24; D06P 2001/0084; D06P 2001/0088; D06P 1/622
USPC ..... 8/580
See application file for complete search history.

(56) References Cited

U.S. PATENT DOCUMENTS 5,009,668 A * 4/1991 Berendt ..... D06P 1/6131 510/535
5,427,589 A * 6/1995 Holsten ..... D06P 1/625 8/586
5,437,690 A * 8/1995 Caldwell ..... D06P 1/6427 8/590

* cited by examiner

*Primary Examiner* — Eisa B Elhilo
(74) *Attorney, Agent, or Firm* — Hilary Dorr Lang; Mark J. Patterson; Patterson Intellectual Property Law, PC

(57) ABSTRACT

A dye additive suitable for use in improving the dyeing of aramid fibers includes non-water components dissolved in water. The non-water components include about 20-25% (w/w) sodium or potassium nitrate; about 20-25% (w/w) ketone solvent; about 30-40% (w/w) aromatic solvent; about 1-5% (w/w) of each of glycol ether, biodegradable solvent, acetic acid 56% strength or equivalent or equivalent amount of formic acid, brine salt, sodium or potassium hydroxide, and phenylenediamine, about 1-10% (w/w) of each of a strong acid, hydroxycarboxylic acid, and lanolin; wherein the water makes up about 50-70% of the weight of the dye additive and the non-water components make up about 30-50% of the dye additive. The dye additive may be added to a dye bath at a w/w percentage of about 0.25% to about 6%.

21 Claims, No Drawings

DYE ADDITIVE AND PROCESS FOR DYEING ARAMID FIBERS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Aromatic polyimide (aramid) fibers, for example, Kevlar®, are well known in the art. Aramids are polyamides wherein at least 85% of the amide (—CONH—) linkages are attached directly to two aromatic rings. Aramids have high tensile strength and are flame and heat resistant, which makes them particularly suited to be formed into fabrics usable as protective clothing, and for many other uses.

Aramids are known to be difficult to dye. Further, aramid fibers (e.g., Kevlar®) will degrade and deteriorate at high temperatures under acidic conditions, such as those used in dye baths.

Accordingly, there is a need in the art for dyeing additives to prevent degradation of aramid fibers during the dyeing process, even at high temperatures, and to improve properties of the dyed fiber, such as depth, levelness, yarn count, and single end strength.

BRIEF SUMMARY OF THE INVENTION

Dye bath additive compositions and methods of using them are disclosed herein. The compositions and methods can prevent degradation of aramid fibers and improve properties of the dyed fiber, such as depth, levelness, yarn count, and single end strength.

In one aspect, the present invention relates to a dye bath additive having a mixture of water and non-water components. The non-water components include: about 20-25% (w/w) sodium or potassium nitrate; about 20-25% (w/w) ketone solvent; about 30-40% (w/w) aromatic solvent; about 1-5% (w/w) of each of glycol ether, biodegradable solvent, acetic acid 56% strength or equivalent or equivalent amount of formic acid, brine salt, sodium or potassium hydroxide, and phenylenediamine; and about 1-10% (w/w) of each of a strong acid, hydroxycarboxylic acid, and lanolin. The percentages of each of the non-water components (the sodium or potassium nitrate, the ketone solvent, the aromatic solvent, the glycol ether, the biodegradable solvent, the acetic acid 56% strength or equivalent or equivalent amount of formic acid, the brine salt, the sodium or potassium hydroxide, the phenylenediamine, the strong acid, the hydroxycarboxylic acid, and the lanolin) add up to 100. The non-water components make up about 30-50% of the total weight of the dye additive, and the water makes up about 50-70% of the total weight of the dye additive. The non-water components are dissolved in the water.

In certain embodiments, the sodium or potassium nitrate is present at about 22% (w/w) of the non-water components. In certain embodiments, the ketone solvent is present at about 20% (w/w) of the non-water components. In certain embodiments, the aromatic solvent is present at about 35% (w/w) of the non-water components. In certain embodiments, the glycol ether is present at about 2% (w/w) of the non-water components. In certain embodiments, the biodegradable solvent is present at about 1% (w/w) of the non-water components. In certain embodiments, the acetic acid 56% strength or equivalent or an equivalent amount of formic acid is present at about 2% (w/w) of the non-water components. In certain embodiments, the brine salt is present at about 2% (w/w) of the non-water components. In certain embodiments, the sodium or potassium hydroxide is present at about 1% (w/w) of the non-water components. In certain embodiments, the phenylenediamine is present at about 2% (w/w) of the non-water components. In certain embodiments, the strong add is present at about 4% (w/w) of the non-water components. In certain embodiments, the hydroxycarboxylic acid is present at about 4% (w/w) of the non-water components. In certain embodiments, the lanolin is present at about 5% (w/w) of the non-water components. In certain embodiments, the water makes up about 60% of the total weight of the dye additive.

In another aspect, the present invention relates to a dye bath additive including a) about 50-70% water; b) about 5-10% (w/w) sodium or potassium nitrate; c) about 5-10% (w/w) ketone solvent; d) about 10-20% (w/w) aromatic solvent; e) about 0.5-1.5% (w/w) of glycol ether, f) about 0.1-1% (w/w) of biodegradable solvent; g) about 0.5-1.5% (w/w) of acetic acid 56% strength or equivalent or equivalent amount of formic acid; h) about 0.5-1.5% (w/w) of brine salt; i) about 0.1-1% (w/w) of sodium or potassium hydroxide; j) about 0.5-1.5% (w/w) of phenylenediamine; and k) about 0.5-3% (w/w) of a strong acid; l) about 0.5-3% (w/w) of hydroxycarboxylic acid; and m) about 1-4% (w/w) of lanolin, wherein the amounts of the components listed in a)-m) add up to 100%.

In certain embodiments, the dye bath additive includes about 60% (w/w) water. In certain embodiments, the dye bath additive includes about 8.8% (w/w) sodium or potassium nitrate. In certain embodiments, the dye bath additive includes about 8% (w/w) ketone solvent. In certain embodiments, the dye bath additive includes about 14% (w/w) aromatic solvent. In certain embodiments, the dye bath additive includes about 0.8% (w/w) glycol ether. In certain embodiments, the dye bath additive includes about 0.4% (w/w) biodegradable solvent. In certain embodiments, the dye bath additive includes about 0.8% (w/w) acetic acid 56% strength or equivalent or equivalent amount of formic acid. In certain embodiments, the dye bath additive includes about 0.8% (w/w) brine salt. In certain embodiments, the dye bath additive includes about 0.4% (w/w) sodium or potassium hydroxide. In certain embodiments, the dye bath additive includes about 0.8% (w/w) phenylenediamine. In certain embodiments, the dye bath additive includes about 1.6% (w/w) strong acid. In certain embodiments, the dye bath additive includes about 1.6% (w/w) hydroxycarboxylic acid. In certain embodiments, the dye bath additive includes about 2% (w/w) lanolin.

In another aspect, the present invention relates to a method of dyeing an aramid fiber, the method comprising adding to a dye bath any one of the dye bath additive compositions disclosed herein. In certain embodiments, the dye bath additive is added to a dye bath at a w/w percentage of between about 0.25% and about 6%, wherein the w/w percentage refers to the ratio of the weight of the dye bath additive to the net weight of the aramid fiber to be dyed.

In another aspect, the present invention relates to a method for preparing an aramid fiber dye additive. The method can include the steps of a) adding water to a mixing vessel, b) adding the following non-water components to the mixing vessel, wherein the percentages of the non-water components add up to 100: 20-25% (w/w) sodium or potassium nitrate; 20-25% (w/w) ketone solvent; 30-40% (w/w) aromatic solvent; 1-5% (w/w) of each of the following: glycol ether, biodegradable solvent, acetic acid 56% strength or equivalent or equivalent amount of formic acid, brine salt, sodium or potassium hydroxide, phenylenediamine; and 1-10% (w/w) of each of the following: a strong acid; hydroxycarboxylic acid; and lanolin; wherein the water and non-water components form a mixture, wherein the water makes up about 50-70% of the weight of the mixture and the non-water components make up about 30-50% of the weight of the mixture; and c) mixing until the non-water components of the mixture are substantially in solution.

In certain embodiments, the water and non-water components of the mixture are added in the following order: water, aromatic solvent, ketone solvent, glycol ether, biodegradable solvent, acetic acid 56% strength or equivalent or equivalent amount of formic acid, sodium or potassium nitrate, brine salt, sodium or potassium hydroxide, strong acid, hydroxycarboxylic acid, lanolin, phenylenediamine.

In certain embodiments, the method further includes the following steps occurring between steps b) and c): i) mixing the mixture while increasing its temperature to about 140° F.-180° F.; ii) mixing the mixture for about 12-36 hours; and iii) reducing the temperature of the mixture. In certain embodiments, step ii) is performed at about 140° F.-180° F. In certain embodiments, step iii) is performed at about 65° F.-105° F.

In certain embodiments, the mixing in steps i) and ii) is substantially continuous. In certain embodiments, in step i), the temperature is heated at a rate of rise of no more than about 3° F. per minute. In certain embodiments, the mixing in step ii) occurs for at least about 24 hours. In certain embodiments, the mixing in step ii) occurs at atmospheric pressure.

In certain embodiments, the mixing in step c) occurs at least once daily. In certain embodiments, the mixing in step c) occurs for about 10-30 minutes once daily. In certain embodiments, the mixing in step c) occurs for about 15 minutes once daily. In certain embodiments, step c) lasts for about 10-60 days, e.g., about 30 days.

In certain embodiments, the sodium or potassium nitrate is present at about 22% (w/w). In certain embodiments, the ketone solvent is present at about 20% (w/w). In certain embodiments, the aromatic solvent is present at about 35% (w/w). In certain embodiments, the glycol ether is present at about 2% (w/w). In certain embodiments, the biodegradable solvent is present at about 1% (w/w). In certain embodiments, the acetic acid 56% strength or equivalent or an equivalent amount of formic acid is present at about 2% (w/w). In certain embodiments, the brine salt is present at about 2% (w/w). In certain embodiments, the sodium or potassium hydroxide is present at about 1% (w/w). In certain embodiments, the phenylenediamine is present at about 2% (w/w). In certain embodiments, the strong acid is present at about 4% (w/w). In certain embodiments, the hydroxycarboxylic acid is present at about 4% (w/w). In certain embodiments, the lanolin is present at about 5%. In certain embodiments, the water makes up about 60% (w/w) of mixture and the non-water components make up about 40% (w/w) of the mixture.

DETAILED DESCRIPTION OF THE INVENTION

The present invention relates to additives useful in improving the dyeing of aramid fibers, such as poly(p-phenyleneterephthalamide) (e.g., Kevlar®, sold by E. I. du Pont de Nemours and Co. (USA) ("DuPont"). The compositions disclosed herein can be used to prevent degradation of aramid fibers during the dyeing process and to improve properties of the dyed fiber, such as depth, levelness, yarn count, and single end strength. The present invention also relates to methods of dyeing aramid fibers using the additives described herein and methods of making the dye additives described herein.

Aramid fibers, also known as high molecular weight aromatic polyamide fibers, are known in the art and described in, e.g., U.S. Pat. No. 4,198,494. Aramid fibers are made from high molecular weight polymers that are highly crystalline and have either a high or no glass transition temperature. Exemplary fibers include Nomex® and Kevlar® by DuPont, USA, and Conex® by Teijin Ltd. (Japan).

The preparation of aramid fibers from aromatic polyamide polymers is disclosed in U.S. Pat. No. 3,063,966 to Kwolek, Morgan and Sorenson; U.S. Pat. No. 3,094,511 to Hill, Kwolek and Sweeny; and U.S. Pat. No. 3,287,324 to Sweeny, for example. These patents and their teachings are incorporated by reference into this application.

Suitable aramid fibers for use herein include Twaron®, Sulfron®, Technora®, and Conex® (Teijin Ltd., Japan); Heracon™ (Kolon Industries Inc., Korea); and Nomex® or Kevlar® (DuPont, USA). Aramid fibers are described in Man-Made Fibres—Science and Technology, Volume 2, Section titled Fibre-Forming Aromatic Polyamides, page 297, W. Black et al., Interscience Publishers, 1968, as well as in U.S. Pat. Nos. 3,767,756; 4,172,938; 3,869,429; 3,869,430; 3,819,587; 3,673,143; 3,354,127; and 3,094,511.

Kevlar® is a polymer formed from the monomers 1,4-phenylene-diamine and terephthaloyl chloride. Its chemical name is poly-para-phenylene terephthalamide. Nomex® is a polymer formed from the monomers m-phenylenediamine and isophthaloyl chloride. Its chemical name is poly-meta-phenylene isophthalamide.

Suitable dyes for use in the present method can include acid dyes (e.g., azo, triarylmethane, anthraquinone dyes etc.); basic dyes (e.g., triphenylmethane, thiazine dyes, etc.); direct dyes (e.g. sulphonated azo dyes etc.); mordant dyes; vat dyes; disperse dyes (e.g., nitroarylamine, azo, or anthraquinone dyes and the like with amino groups); direct dyes; reactive dyes; and mixtures thereof. Particularly effective dyes for dyeing aramid fibers are the basic dyes (sometimes referred to as "cationic dyes"). An example of this class is the Basacryl® dyes available from BASF (Charlotte, N.C.).

A dye additive suitable for use as described herein includes water and non-water components. In certain embodiments, the non-water components include 20-25% (w/w) sodium or potassium nitrate; about 20-25% (w/w)

ketone solvent; about 30-40% (w/w) aromatic solvent; about 1-5% (w/w) of each of glycol ether, biodegradable solvent, acetic acid 56% strength or equivalent or equivalent amount of formic acid, brine salt, sodium or potassium hydroxide, and phenylenediamine, about 1-10% (w/w) of each of strong acid, hydroxycarboxylic acid, and lanolin; wherein the percentages of the non-water components (sodium or potassium nitrate, the ketone solvent, the aromatic solvent, the glycol ether, the biodegradable solvent, the acetic acid 56% strength or equivalent or equivalent amount of formic acid, the brine salt, the sodium or potassium hydroxide, the phenylenediamine, the strong acid, the hydroxycarboxylic acid, and the lanolin) add up to 100, and the water makes up about 50-70% of the total weight of the dye additive, and the non-water components make up about 30-50% of the total weight of the dye additive. The non-water components are dissolved in the water.

In certain embodiments, the dye additive includes sodium or potassium nitrate. In certain embodiments, the dye additive includes sodium nitrate, available from Phoenix Chemical (Calhoun, Ga.).

In certain embodiments, the ketone solvent is acetone, acetophenone, butanone, cyclopentanone, ethyl isopropyl ketone, 2-hexanone, isophorone, mesityl oxide, methyl isobutyl ketone, methyl isopropyl ketone, 3-methyl-2-pentanone, 2-pentanone, 3-pentanone, or any combination thereof. In certain embodiments, the ketone solvent is acetophenone, available from Expo Chemical (Magnolia, Tex.).

In certain embodiments, the aromatic solvent is benzyl alcohol, available from Phoenix Chemical (Calhoun, Ga.). In certain embodiments, the aromatic solvent is benzene, m-xylene, o-xylene, pseudocumene, p-xylene, styrene, toluene, xylene, or any combination thereof. In certain embodiments, the aromatic solvent is benzyl alcohol, toluene or xylene.

In certain embodiments, the glycol ether is ethylene glycol monomethyl ether, ethylene glycol monomethyl ether acetate, ethylene glycol monoethyl ether, ethylene glycol monoethyl ether acetate, ethylene glycol monopropyl ether, ethylene glycol monobutyl ether, ethylene glycol dimethyl ether, ethylene glycol diethyl ether, diethylene glycol, diethylene glycol monomethyl ether, ethanol diethylene glycol monoethyl ether, diethylene glycol monobutyl ether, ethanol, diethylene glycol dimethyl ether, triethylene glycol dimethyl ether, propylene glycol monomethyl ether, propylene glycol monomethyl ether acetate, dipropylene glycol, dipropylene glycol monomethyl ether, or any combination thereof. In certain embodiments, the glycol ether is CINDYE C-45® available from Bozzetto (Greensboro, N.C.).

In certain embodiments, the biodegradable solvent is a lactate ester. In certain embodiments, the lactate ester s ethyl lactate, methyl lactate, butyl lactate, isopropyl lactate, or any combination thereof. In certain embodiments, the biodegradable solvent is ethyl lactate, available from Vertec BioSolvents, Inc. (Downers Grove, Ill.).

In certain embodiments, the acetic acid (also called ethanoic acid) is used at 56% strength. Acetic acid is available from Phoenix Chemical (Calhoun, Ga.). Higher or lower strengths can be used if the amount is adjusted accordingly, as is understood by one skilled in the art. In certain embodiments, formic acid can be used instead of acetic acid. If used at full-strength, formic acid may be present at about 0.5% to about 2.5% of the non-water component. In certain embodiments, other carboxylic acids can be substituted for the acetic acid, including, for example, propionic acid, butyric acid, valeric acid, caproic acid, enanthic acid, caprylic acid, pelargonic acid, capric acid, undecylic acid, lauric acid, tridecylic acid, myristic acid, pentadecanoic acid, palimitic acid, margaric acid, stearic acid, nonadecylic acid, and arachidic acid. If used at full-strength, the carboxylic acid may be present at about 0.5% to about 2.5% of the non-water component.

As used herein, brine salt refers to sodium chloride, sodium sulfate and potassium chloride. Typically, brine salt granules are used, but as the skilled artisan will recognize, and equivalent amount of a liquid solution also can be used. Brine salt can be obtained from many commercial suppliers including, for example, Avalon IS-LO from Melatex (Charlotte, N.C.).

Phenylenediamine (e.g., p-Phenylenediamine (PPD), o-Phenylenediamine (OPD), and m-Phenylenediamine (MPD)) is a member of the diaminobenzene family. In certain embodiments, another diaminobenzene is substituted for phenylenediamine. In certain embodiments, the phenylenediamine is PPD, OPD, MPD, or any combination thereof. In certain embodiments, the phenylenediamine is PPD or MPD. PPD, OPD and MPD are available from DuPont (USA).

A strong acid as described herein is an acid which is essentially 100% ionized in solution. Examples of strong acids are sulfamic (sulphamic) acid, hydroiodic acid, hydrobromic acid, sulfuric acid, p-Toluenesulfonic acid, and methansulfonic acid. In certain embodiments, the strong acid is sulfamic (sulphamic) acid, perchloric acid, hydroiodic acid, hydrobromic acid, hydrochloric acid, sulfuric acid, p-Toluenesulfonic acid, mathansulfonic acid, or any combination thereof. In certain embodiments, the strong acid is sulfamic (sulphamic) acid, available from Phoenix Chemical (Calhoun, Ga.).

In certain embodiments described herein, sodium hydroxide, also known as caustic soda, is used. Sodium hydroxide is available from Phoenix Chemical (Calhoun, Ga.). In other embodiments, potassium hydroxide is fully or partially substituted for the sodium hydroxide.

The hydroxycarboxylic acid described herein can be, e.g., citric acid, tartaric acid, gluconic acid, malic acid, fumaric acid, or any combination thereof. In certain embodiments, the hydroxycarboxylic acid is citric acid, available from Phoenix Chemical (Calhoun, Ga.).

Lanolin is a waxy derivative from sheep's wool. As used herein, lanolin can refer to, e.g., lanolin acid, acetylated lanolin, lanolin oil, or any combination thereof. In certain embodiments, the lanolin is lanolin acid, available from, e.g., Rita Corp. (Crystal Lake, Ill.)).

In certain embodiments, the sodium or potassium nitrate is present at about 22% (w/w) of the non-water components. In certain embodiments, the ketone solvent is present at about 20% (w/w) of the non-water components. In certain embodiments, the aromatic solvent is present at about 35% (w/w) of the non-water components. In certain embodiments, the glycol ether is present at about 2% (w/w) of the non-water components. In certain embodiments, the biodegradable solvent is present at about 1% (w/w) of the non-water components. In certain embodiments, the acetic acid 56% strength or equivalent or an equivalent amount of formic acid is present at about 2% (w/w) of the non-water components. In certain embodiments, the brine salt is present at about 2% (w/w) of the non-water components. In certain embodiments, the sodium or potassium hydroxide is present at about 1% (w/w) of the non-water components. In certain embodiments, the phenylenediamine is present at about 2% (w/w) of the non-water components. In certain embodiments, the strong acid is present at about 4% (w/w) of the non-water components. In certain embodiments, the hydroxycarboxylic acid is present at about 4% (w/w) of the non-water components. In certain embodiments, the lanolin is present at about 5% (w/w) of the non-water components. In certain embodiments, the water makes up about 60% of the total weight of the dye additive, and the non-water components make up about 40% of the dye additive.

In another aspect, the present invention relates to a dye bath additive including:

a) about 50-70% (e.g., about 50-60%, about 60-70%, about 55-65% (w/w)) water;

b) about 5-10% (e.g., about 5-9%, about 8-10%, about 6-9% (w/w)) sodium or potassium nitrate;

c) about 5-10% (e.g., about 5-9%, about 8-10%, about 6-9% (w/w)) ketone solvent;

d) about 10-20% (e.g., about 10-15%, about 14-20%, about 12-18%, about 14-16% (w/w)) aromatic solvent;

e) about 0.5-1.5% (e.g., about 0.5-1%, about 0.8-1.5%, about 0.7-1.3% (w/w)) of glycol ether, f) about 0.1-1.0% (e.g., about 0.1-0.5%, about 0.4-1.0%, about 0.3-0.7% (w/w)) of biodegradable solvent;

g) about 0.5-1.5% (e.g., about 0.5-1%, about 0.8-1.5%, about 0.7-1.3% (w/w)) of acetic acid 56% strength or equivalent or equivalent amount of formic acid;

h) about 0.5-1.5% (e.g., about 0.5-1%, about 0.8-1.5%, about 0.7-1.3% (w/w)) of brine salt;

i) about 0.1-1.0% (e.g., about 0.1-0.5%, about 0.4-1.0%, about 0.3-0.7% (w/w)) of sodium or potassium hydroxide;

j) about 0.5-1.5% (e.g., about 0.5-1%, about 0.8-1.5%, about 0.7-1.3% (w/w)) of phenylenediamine; and k) about 0.5-3% (e.g., about 0.5-1.6%, about 1-2%, about 1.6-3% (w/w)) of a strong acid;

l) about 0.5-3% (e.g., about 0.5-1.6%, about 1-2%, about 1.6-3% (w/w)) of hydroxycarboxylic acid; and m) about 1-4% (e.g., about 1-2%, about 1-3%, about 2-4% (w/w)) of lanolin, wherein the amounts of the components listed in a)-m) total 100%.

In certain embodiments, the dye bath additive includes about 60% (w/w) water. In certain embodiments, the dye bath additive includes about 8.8% (w/w) sodium or potassium nitrate. In certain embodiments, the dye bath additive includes about 8% (w/w) ketone solvent. In certain embodiments, the dye bath additive includes about 14% (w/w) aromatic solvent. In certain embodiments, the dye bath additive includes about 0.8% (w/w) glycol ether. In certain embodiments, the dye bath additive includes about 0.4% (w/w) biodegradable solvent. In certain embodiments, the dye bath additive includes about 0.8% (w/w) acetic acid 56% strength or equivalent or equivalent amount of formic acid. In certain embodiments, the dye bath additive includes about 0.8% (w/w) brine salt. In certain embodiments, the dye bath additive includes about 0.4% (w/w) sodium or potassium hydroxide. In certain embodiments, the dye bath additive includes about 0.8% (w/w) phenylenediamine. In certain embodiments, the dye bath additive includes about 1.6% (w/w) strong acid. In certain embodiments, the dye bath additive includes about 1.6% (w/w) hydroxycarboxylic acid. In certain embodiments, the dye bath additive includes about 2% (w/w) lanolin.

In another aspect, the present invention relates to a method for preparing an aramid fiber dye additive. The method can include the steps of a) adding water to a mixing vessel, b) adding the following non-water components to the mixing vessel, wherein the percentages of the non-water components add up to 100: 20-25% (w/w) sodium or potassium nitrate; 20-25% (w/w) ketone solvent; 30-40% (w/w) aromatic solvent; 1-5% (w/w) of each of the following: glycol ether, biodegradable solvent, acetic acid 56% strength or equivalent or equivalent amount of formic acid, brine salt, sodium or potassium hydroxide, phenylenediamine; and 1-10% (w/w) of each of the following: strong acid; hydroxycarboxylic acid; and lanolin; to form a mixture wherein the water makes up about 50-70% of the total weight of the mixture and the non-water components make up about 30-50% of the total weight of the mixture; and c) mixing until the non-water components of the mixture are substantially in solution.

In certain embodiments, for safety considerations, the water and non-water components of the mixture are added in the order: water, aromatic solvent, ketone solvent, glycol ether, biodegradable solvent, acetic acid 56% strength or equivalent or equivalent amount of formic acid, sodium or potassium nitrate, brine salt, sodium or potassium hydroxide, strong acid, hydroxycarboxylic acid, lanolin, phenylenediamine. However, as the skilled artisan understands, the components of the mixture can be added in any order so long as unsafe reactions are avoided.

The non-water components of the mixture can be added in solid or liquid form. In certain embodiments, the sodium or potassium nitrate is added as a solid (e.g., granules), the ketone solvent is added in liquid form, the aromatic solvent is added in liquid form, the glycol ether is added in liquid form, the biodegradable solvent is added in liquid form, the acetic acid (56% strength) or formic acid is added in liquid form, the brine salt is added as a solid (e.g., granules), the sodium or potassium hydroxide (also known as caustic soda) is added as a solid (e.g., flakes or pearls), the phenylenediamine is added as a solid (e.g., flakes), the strong acid is added as a solid (e.g., granules), the hydroxycarboxylic acid is added as a solid (e.g., granules), and/or the lanolin is added as a solid (e.g., wax). The chemical components described herein are used in the textile industry and can be obtained from a variety of commercial chemical suppliers. Unless stated otherwise, the non-water components used are full-strength (undiluted) industrial grade.

In certain embodiments, the method further includes the following steps occurring between steps b) and c): i) mixing the mixture while increasing its temperature to about 140° F. 180° F.; ii) mixing the mixture for about 12-36 hours; and iii) reducing the temperature of the mixture. In certain embodiments, step ii) is performed at about 140° F.-180° F. In certain embodiments, step iii) is performed at about 65° F.-105° F.

The mixing in steps i) and ii) can be substantially continuous or periodic (e.g., once every hour, once every other hours, once every 12 hours, once every day). In certain embodiments, in step i), the temperature is heated at a rate of rise of no more than about 1-5° F. (e.g., no more than about 1° F., nor more than about 2° F., no more than about 3° F., no more than about 4° F., or no more than about 5° F. per minute).

In certain embodiments, the mixing in step ii) occurs for at least about 12 hours, 18 hours, 24 hours, 36 hours or 48 hours. In certain embodiments, the mixing in step ii) occurs at atmospheric pressure. In certain embodiments, the mixing in step ii) is performed at about 140° F.-180° F. In certain embodiments, the mixing in step ii) is performed at about 155° F.-165° F. In certain embodiments, the mixing in step ii) is performed at about 160° F. As the skilled artisan will appreciate, if the mixing occurs at higher temperature and/or higher pressure, the mixing time can be decreased. If the mixing occurs at lower temperature and/or lower pressure, the mixing time can be increased to facilitate dissolving the non-water components into the water.

In certain embodiments, the mixing in step iii) is performed at about 65° F.-105° F. In certain embodiments, the mixing step iii) is performed at about 75° F.-95° F. In certain embodiments, the mixing step iii) is performed at about 85° F.

In certain embodiments, the mixing in step c) occurs continuously. In other embodiments, the mixing in step c) occurs periodically, e.g., at least once daily. In certain embodiments, the mixing in step c) occurs for about 10-30 minutes once daily. In certain embodiments, the mixing in step c) occurs for about 10 minutes once daily, about 15 minutes once daily, about 20 minutes once daily, about 25 minutes once daily, or about 30 minutes once daily. In certain embodiments, step c) lasts for about 10-60 days, e.g., 10 days, 15 days, 20 days, 25 days, 30 days, 35 days, 40 days, 45 days, 50 days, 55 days, or 60 days. In certain embodiments, the mixing in step c) occurs until more than 95% or more than 99% of the non-water components are in solution. In certain embodiments, the mixing in step c) occurs until 100% of the non-water components are in solution.

In certain embodiments, the sodium or potassium nitrate is present at about 22% (w/w) of the non-water components. In certain embodiments, the ketone solvent is present at about 20% (w/w) of the non-water components. In certain embodiments, the aromatic solvent is present at about 35% (w/w) of the non-water components. In certain embodiments, the glycol ether is present at about 2% (w/w) of the non-water components. In certain embodiments, the biodegradable solvent is present at about 1% (w/w) of the non-water components. In certain embodiments, the acetic acid 56% strength or equivalent or an equivalent amount of formic acid is present at about 2% (w/w) of the non-water components. In certain embodiments, the brine salt is present at about 2% (w/w) of the non-water components. In certain embodiments, the sodium or potassium hydroxide is present at about 1% (w/w) of the non-water components. In certain embodiments, the phenylenediamine is present at about 2% (w/w) of the non-water components. In certain embodiments, the strong add is present at about 4% (w/w) of the non-water components. In certain embodiments, the hydroxycarboxylic acid is present at about 4% (w/w) of the non-water components. In certain embodiments, the lanolin is present at about 5% (w/w) of the non-water components. In certain embodiments, the water makes up about 60% of the total weight of the mixture and the non-water components make up about 40% of the total weight of the mixture.

In another aspect, the present invention relates to a method of dyeing an aramid fiber, the method comprising, adding to a dye bath any one of the dye bath additive compositions disclosed herein. "Dye bath additive composition" is also referred to herein as an "additive," "dye additive," "dye bath additive," "dyeing additive," or "dyeing additive composition." In certain embodiments, the dyeing additive is added to a dye bath comprising dye and an aramid fiber. In other embodiments, the method includes adding a dye and/or an aramid fiber.

In certain embodiments, the dye additive is added at a w/w (weight of dye additive to net weight of aramid fiber to be dyed) percentage of about 0.01% to about 6%. Net weight is defined as the weight of the aramid fiber without its packaging. Aramid goods, i.e., any aramid material capable of being dyed, are made from aramid fiber, and include, for example, aramid yarn, filament, fabric, rope, cable, zipper tape, hook and loop (e.g., Velcro®), etc.). In certain embodiments, the dye additive is used to enhance the dyeing of one or more aramid goods.

In certain embodiments, the dye bath additive is added at between about 0.01% and 6% (w/w), at about 0.01% and about 5% (w/w), at about 0.01% and about 3% (w/w), at about 0.01% and about 1% (w/w), at about 0.01% and about 0.25% (w/w). In certain embodiments, the dye bath additive is added at between about 0.25% and 6% (w/w), at between about 0.25% and about 5% (w/w), at between about 0.25% and about 3% (w/w), at between about 0.25% and about 1% (w/w), at between about 1% and about 3% (w/w), at between about 1% and about 5% (w/w), at between about 1% and about 6% (w/w), at between about 3% and about 5% (w/w), or at between about 3% and about 6% (w/w). For darker dye shades, e.g., black, the dyeing solvent can be replaced with dye additive at a ratio of 1-2 parts of solvent removed for every one part of dyeing additive added.

Mixing vessels suitable for use with the methods disclosed herein include any vessel or container suitable for use in dyeing fibers. The skilled artisan will understand that the vessel should not be reactive to the components of the dye additive or the particular dye and fiber chosen. The term "dye bath" as used herein refers to the liquid solution used to dye aramid fibers. Dye baths suitable for use with the methods disclosed herein are well known in the art.

Use of the dyeing additives described herein can increase depth and levelness of an aramid fiber. Depth and levelness are measured by visual inspection.

Use of the dyeing additives disclosed herein can increase yarn count of an aramid fiber. Yarn count can be measured in any way known in the art, including metric count (Nm; number of meters of yarn per gram), Tex (tex; weight of gram of 1000 meters), and Denier (den; weight in gram of 9000 meters). The methods of the present invention can increase yarn count of an aramid fiber (e.g., Kevlar® or Nomex®) by at least 1%, at least 2%, at least 5%, at least 15%, at least 30%, at least 50%, at least 100% or at least 200%. In certain embodiments, use of a dye additive as disclosed herein increases yarn count of an aramid fiber by about 1-200%, by about 2-100%, by about 5-50%, or by about 15-30%.

At high temperatures (e.g., 250° F.) in an acid dye bath, aramid fibers such as Kevlar® degrade. Use of the dyeing additives disclosed herein can increase dyeing temperature of the fiber, i.e., allow for a higher dyeing temperature to be used with less degradation of the fiber. In certain embodiments, the amount of degradation is measured by single end (breaking) strength. Single end strength can be measured by any method known in the art, including, for example, using a single end yarn strength tester (available, e.g., from SDL Atlas Inc., USA). In certain embodiments, use of a dye additive as disclosed herein increases single end strength of an aramid fiber by at least about 1%, at least about 2%, at least about 5%, at least about 15%, at least about 30%, at least about 50%, at least about 100% or at least about 200%. In certain embodiments, use of a dye additive as disclosed herein increases single end strength of an aramid fiber by about 1-200%, by about 2-100%, by about 5-50%, or by about 15-30%.

EXAMPLES

Example 1

An exemplary dye additive was made using the following:

Non-water components (40% of total weight of dye additive)

1) 22.00% Sodium Nitrate (granules)
2) 20.00% Acetophenone (liquid)

3) 35.00% Benzyl Alcohol (liquid)
4) 2.00% Glycol Ether (liquid)
5) 1.00% Ethyl Lactate (liquid)
6) 2.00% Acetic Acid 56% strength (liquid)
7) 2.00% Brine Salt (granules)
8) 1.00% Caustic Soda (Sodium Hydroxide) (flakes or pearls)
9) 2.00% PPD (p-Phenylenediamine) (flakes)
10) 4.00% Sulfamic Acid (granules)
11) 4.00% Citric Acid (granules)
12) 5.00% Lanolin Acid (solid, wax)
and
Water (60% of total weight of dye additive)

Components 1-13 (above) were added in the following order:

1) Water
2) Benzyl Alcohol (item 3)
3 Acetophenone (item 2)
4) Glycol Ether (item 4)
5) Ethyl Lactate (item 5)
6) Acetic Acid 56% strength (item 6)
7) Sodium Nitrate (item 1)
8) Brine Salt (item 7)
9) Caustic Soda (item 8)
10) Sulfamic Acid (item 10)
11) Citric Acid (item 11)
12) Lanolin Acid (item 12)
13) PPD (item 9)

Components were mixed while being added to a mixing vessel without heat in a well-ventilated area. Proper protective eye wear, clothing, and breathing/oxygen mask were used to prevent exposure to components. The mixing vessel was heated to 160° F. at a rate of rise no more than 3° F. per minute. Mixing was continued at 160° F. for twenty-four hours at atmospheric pressure. The temperature was reduced to 85° F. The mixture was then mixed once daily for fifteen minutes over the next thirty days. After thirty days, the mixture was substantially dissolved into solution, with some staining residue remaining at the bottom of the mixing vessel. The dye additive was stored at between 60 and 90° F.

Example 2

Small quantities (about 0.25% based on weight of goods) of the dyeing additive of Example 1 were added to Kevlar® fiber or Nomex® fiber as a dyeing additive. Increased depth, increased levelness, increased yarn count, and increased single end strength were observed following exposure to the dyeing additive. Specifically, Nomex® treated with the dye additive broke at an average of 2.78 pounds (compared to 2.22 pounds for untreated Nomex®). Kevlar® treated with the dye additive broke at an average of 6.39 pounds (compared to 5.28 pounds for untreated Kevlar®). In addition, the dye additive allowed for higher dyeing temperatures to be used; Kevlar® and Nomex® fiber will degrade and deteriorate at high temperatures in an acid bath without this additive.

The dyeing additive was used at higher quantities based upon shade depth up to a maximum of 6.00% (weight of dyeing additive to net weight of yarn) for black yarn. Above a maximum of 6.00% usage, the dyeing additive was observed to over size yarn and have a browning effect and become more difficult to scour. For darker/heavier shades, it is possible to replace the current dyeing solvent at a ratio of 1:1 up to 2 parts of solvent removed for every one part of dyeing additive added depending upon solvent of choice. Post dyeing yarn scouring and finishing were performed as usual. Inherent properties of dyed fiber using the dyeing additive showed no significant physical changes except for the enhanced sizing and strength.

All patent literature and scientific publications found herein are incorporated in their entirety for all purposes.

Although there have been described particular embodiments of the present invention of a new and useful dye additive and methods of making and using same, it is not intended that such references be construed as limitations upon the scope of this invention except as set forth in the following claims.

What is claimed is:

1. A dye bath additive comprising water and non-water components, wherein:

the non-water components comprise
about 20-25% (w/w) sodium or potassium nitrate,
about 20-25% (w/w) ketone solvent,
about 30-40% (w/w) aromatic solvent,
about 1-5% (w/w) of each of the following: glycol ether, biodegradable solvent; acetic acid 56% strength or equivalent or an equivalent amount of formic acid; brine salt; sodium or potassium hydroxide; and phenylenediamine,
about 1-10% (w/w) of each of the following: strong acid; hydroxycarboxylic acid; and lanolin,
wherein the non-water components make up about 30-50% of the total weight of the dye additive and
the water makes up about 50-70% of the total weight of the dye additive; and
the non-water components are dissolved in the water.

2. The dye bath additive of claim 1, wherein the water makes up about 60% of the total weight of the dye additive.

3. A method of dyeing an aramid fiber, the method comprising adding to a dye bath the dye bath additive of claim 1.

4. The method of claim 3, wherein the dye bath additive is present at a w/w percentage of about 0.25% to about 6%, wherein the w/w percentage is the weight of the dye bath additive to the net weight of the aramid fiber to be dyed.

5. A dye bath additive comprising:

a) about 50-70% water;
b) about 5-10% (w/w) sodium or potassium nitrate;
c) about 5-10% (w/w) ketone solvent;
d) about 10-20% (w/w) aromatic solvent;
e) about 0.5-1.5% (w/w) of glycol ether;
f) about 0.1-1% (w/w) of biodegradable solvent;
g) about 0.5-1.5% (w/w) of acetic acid 56% strength or equivalent or equivalent amount of formic acid;
h) about 0.5-1.5% (w/w) of brine salt
i) about 0.1-1% (w/w) of sodium or potassium hydroxide;
j) about 0.5-1.5% (w/w) of phenylenediamine;
k) about 0.5-3% (w/w) of strong acid;
l) about 0.5-3% (w/w) of hydroxycarboxylic acid; and
m) about 1-4% (w/w) of lanolin, wherein the components listed in a)-m) total 100% (w/w) of the dye bath additive.

6. A method of dyeing an aramid fiber, the method comprising adding to a dye bath the dye bath additive of claim 5.

7. The method of claim 6, wherein the dye bath additive is present at a w/w percentage of about 0.25% to about 6%, wherein the w/w percentage is the weight of the dye bath additive to the net weight of the aramid fiber to be dyed.

8. A method for preparing an aramid fiber dye additive, the method comprising the steps of:

a) adding water to a mixing vessel;

b) adding the following non-water components to the mixing vessel, wherein the percentages of the non-water components add up to 100% (w/w) of the non-water components:

i) about 20-25% (w/w) sodium or potassium nitrate;

ii) about 20-25% (w/w) ketone solvent;

iii) about 30-40% (w/w) aromatic solvent;

iv) about 1-5% (w/w) of each of the following: glycol ether, biodegradable solvent; acetic acid 56% strength or equivalent or equivalent amount of formic acid; brine salt; sodium or potassium hydroxide; and phenylenediamine; and v) about 1-10% (w/w) of each of the following: strong acid; hydroxycarboxylic acid; and lanolin;

and wherein the water and non-water components form a mixture, wherein the water makes up about 50-70% of the weight of the mixture and the non-water components make up about 30-50% of the weight of the mixture; and c) mixing until the non-water components of the mixture are substantially in solution.

9. The method of claim 8, wherein the water and non-water components of the mixture are added in the order: water, aromatic solvent, ketone solvent, glycol ether, biodegradable solvent, acetic acid 56% strength or equivalent or equivalent amount of formic acid, sodium or potassium nitrate, brine salt, sodium or potassium hydroxide, strong acid, hydroxycarboxylic acid, lanolin, and phenylenediamine.

10. The method of claim 8, wherein, between steps b) and c), the method further comprises the steps of:

i) mixing the mixture while increasing its temperature to about 140° F.-180° F.;

ii) mixing the mixture for about 12-36 hours; and iii) reducing the temperature of the mixture.

11. The method of claim 8, wherein the mixing in steps i) and ii) is continuous.

12. The method of claim 8, wherein in step i), the temperature is heated at a rate of rise of no more than about 3° F. per minute.

13. The method of claim 8, wherein the mixing in step ii) occurs for at least about 24 hours.

14. The method of claim 13, wherein the mixing occurs at atmospheric pressure.

15. The method of claim 8, wherein step iii) is performed at about 65° F.-105° F.

16. The method of claim 8, wherein the mixing in step c) occurs at least once daily.

17. The method of claim 16, wherein the mixing occurs for about 10-30 minutes once daily.

18. The method of claim 17, wherein the mixing occurs for about 15 minutes once daily.

19. The method of claim 8, wherein step c) lasts for about 10-60 days.

20. The method of claim 19, wherein step c) lasts for about 30 days.

21. The dye bath additive of claim 1, wherein the percentages of the sodium or potassium nitrate, the ketone solvent, the aromatic solvent, the glycol ether, the biodegradable solvent, the acetic acid 56% strength or equivalent or equivalent amount of formic acid, the brine salt, the sodium or potassium hydroxide, the phenylenediamine, the strong acid, the hydroxycarboxylic acid, and the lanolin add up to 100% (w/w) of the non-water components.

* * * * *